US012102150B2

(12) United States Patent
Hanson Allen et al.

(10) Patent No.: US 12,102,150 B2
(45) Date of Patent: Oct. 1, 2024

(54) UPPER BODY GARMENT WITH WOVEN TUBULAR SHOULDER STRAPS

(71) Applicant: Spanx, LLC, Atlanta, GA (US)

(72) Inventors: Wendy Hanson Allen, Atlanta, GA (US); Mayur Vansia, Atlanta, GA (US)

(73) Assignee: Spanx, LLC, Atlanta, GA (US)

( * ) Notice: Subject to any disclaimer, the term of this patent is extended or adjusted under 35 U.S.C. 154(b) by 502 days.

(21) Appl. No.: 17/194,590

(22) Filed: Mar. 8, 2021

(65) Prior Publication Data

US 2022/0279867 A1 Sep. 8, 2022

(51) Int. Cl.
*A41F 15/00* (2006.01)
*A41C 3/00* (2006.01)
*A41C 3/02* (2006.01)

(52) U.S. Cl.
CPC ..... *A41F 15/005* (2013.01); *A41C 3/0021* (2013.01); *A41C 3/02* (2013.01)

(58) Field of Classification Search
CPC ..... D03D 3/02; A41F 15/00; A41F 15/005
See application file for complete search history.

(56) References Cited

U.S. PATENT DOCUMENTS 3,153,246 A * 10/1964 Silverman ..... A41F 15/005 450/86
3,653,075 A * 4/1972 Gluckin ..... A41F 9/02 450/86
4,217,906 A * 8/1980 Perron ..... A41F 15/005 450/86
4,343,313 A * 8/1982 Le Jeune ..... A41C 3/065 450/39
5,507,682 A * 4/1996 Grahammer ..... A41F 15/005 2/243.1
6,015,331 A * 1/2000 Ioakim ..... A41C 3/04 450/37

(Continued)

FOREIGN PATENT DOCUMENTS

CN 103194845 B 3/2014
JP 4355184 B2 8/2009

(Continued)

OTHER PUBLICATIONS

Kaynak, Hatice Kubra, "Optimization of stretch and recovery properties of woven stretch fabrics," 2017, Textile Research Journal, vol. 87 (5), pp. 582-592 (Year: 2017).*

*Primary Examiner* — Jocelyn Bravo
(74) *Attorney, Agent, or Firm* — Meunier Carlin & Curfman LLC

(57) ABSTRACT

The upper body garments disclosed herein include shoulder straps formed of a woven tubular material flattened into a double-ply fabric. The woven tubular shoulder straps have advantageously high recovery. The upper body garments also include a torso-encircling main body portion with a breast supporting region coupled to a body strap. The body strap is formed of a circular knit, tubular material flattened into double-ply fabric. The woven tubular shoulder straps are coupled to the circular knit, tubular body strap. In some embodiments, the weft yarn of the woven tubular shoulder straps can have different material properties than the warp yarn of the woven tubular shoulder straps. Methods of making the upper body garments are also disclosed herein.

19 Claims, 8 Drawing Sheets

(56) References Cited

U.S. PATENT DOCUMENTS 6,179,687 B1* 1/2001 Lee ..... A41F 15/002 450/88
6,315,009 B1 11/2001 Jayaraman et al.
6,332,825 B1 12/2001 Henricksen
7,549,302 B2* 6/2009 Duckham ..... A41C 3/0014 66/176
7,814,575 B2 10/2010 Hendrickson et al.
8,808,058 B2 8/2014 Crouch
10,285,454 B1 5/2019 Azan
2003/0034083 A1* 2/2003 Glenn ..... A41B 17/00 139/387 R
2005/0106972 A1* 5/2005 Lam ..... D03D 49/12 156/393
2006/0108386 A1* 5/2006 Lam ..... D03D 11/02 224/158
2008/0127683 A1* 6/2008 Duckham ..... A41C 3/0014 450/86
2010/0093258 A1* 4/2010 Glenn ..... D03D 17/00 2/243.1
2014/0287652 A1* 9/2014 Deguchi ..... A41C 3/0057 450/86
2015/0351474 A1 12/2015 Farmer
2016/0249688 A1* 9/2016 Ibey ..... A41F 15/002 450/88
2017/0233906 A1* 8/2017 Hwang ..... D04B 1/126 450/93
2020/0048798 A1* 2/2020 O'Haire ..... A43B 23/0245

FOREIGN PATENT DOCUMENTS

JP 6081649 B1 1/2017
KR 20020038626 A 5/2002
KR 200477389 Y1 6/2015

* cited by examiner

UPPER BODY GARMENT WITH WOVEN TUBULAR SHOULDER STRAPS

FIELD

This invention relates to upper body garments, and more particularly to brassieres having woven tubular shoulder straps and a circular knit, tubular body strap.

BACKGROUND

Athletic upper body garments, such as sports bras, camisoles, or tank tops, are often formed of knitted fabric because of the inherent stretchability and resulting body conformability of knits. Because of the comfort of knitted upper body garments, their use extends beyond physical activities to general, everyday use.

Conventionally knit bras may be formed of circular knit tubes with the circumference of the tubes extending around the torso of the wearer, in other words, the wearer is inside the tube or the tube is flattened and cut to form integral shoulder straps and folded to form front and rear bra portions that are secured together at side seams. In either case, time consuming and expensive cutting and sewing operations are required, resulting in an expensive waste of cut away material. Also, importantly, shoulder straps are conventionally formed from separate pieces of edging or ribbons of fabric having ends secured to the main body portion, or the tube is knit of sufficient height to provide material for integral strap portions, resulting in an additional waste of material. Further, uncomfortable and conspicuous edge binding material or ribbons are conventionally required to cover the edges of the main body portion and the edges of the shoulder straps.

There are also circular knit bras which are formed of flattened knit tubes with ends sewn or connected to form a body encircling double-ply fabric. An illustration of this type of bra is disclosed in U.S. Pat. No. 3,772,899, which discloses breast pocket portions formed by distending the fabric by forming and stabilizing by heat and pressure. The disclosed bra is strapless or, alternatively, has conventional shoulder straps secured to the main body portion. Another example of a strapless circular knit bra is disclosed in U.S. Pat. No. 5,850,745, which discloses a circular knit fabric that is slit axially to form two separate single-ply bras that extend around the torso of the wearer with breast pocket peripheries formed of elastic fabric. This patent also discloses a single-ply circular knit strapless bra with its axis extending vertically of the wearer and with edges knit with turned welts.

While the prior art discloses circular knit bras that are flattened to form a double-ply fabric that encircles the body of the wearer, such prior art bras either are strapless, offering less support to the wearer, or utilize conventional narrow, relatively hard, shoulder straps. U.S. Pat. No. 7,549,302 discloses a bra formed of a length of circular knit material flattened into a tubular double-ply fabric, with ends of the fabric secured to breast pockets. The breast pockets are supported by shoulder straps, which, like the body strap, are each formed of a circular knit material, flattened into a tubular double-ply fabric (hereinafter, a circular knit, tubular strap). However, circular knit, tubular shoulder straps have certain disadvantages, such as a loss in elasticity over time.

BRIEF SUMMARY

The upper body garment disclosed herein utilizes woven tubular shoulder straps flattened into a double-ply material.

Providing a woven tubular shoulder strap has several advantages over circular knit, tubular shoulder straps. First, because a woven tubular shoulder strap is thinner than a circular knit, tubular material using the same yarn, it is less visible under the clothing. Second, with wovens, different types of yarn can be used in the warp versus the weft of the weave, allowing for exponentially more variations to which material properties can be tailored to match the intended size of the wearer. Third, woven tubular shoulder straps resist deformation (recover) better than circular knit, tubular shoulder straps, maintaining high elasticity for longer periods of time. Fourth, woven tubular shoulder straps are stronger than circular knit, tubular shoulder straps of the same types of yarn. Fifth, the tubular weaving process allows for a broader range of shoulder strap widths than does the hosiery-based circular knitting process.

In summary, disclosed herein is an upper body garment including a torso-encircling main body portion. The torso-encircling main body portion includes a breast supporting region coupled to a body strap. The body strap includes side sections coupled to the breast supporting region and a back section extending from the side sections. The upper body garment further includes shoulder straps coupled to the main body portion. In some examples, the breast supporting region comprises a material different from the material of the body strap and the material of the shoulder straps.

The body strap is formed of a circular knit, tubular material flattened into double-ply fabric. In some examples, the fabric of the side sections of the body strap has a lower elasticity than the fabric of the back section of the body strap. In some examples, the double-ply fabric of the side sections of the body strap is more tightly knit than the double-ply fabric of the back section of the body strap.

The shoulder straps are formed of a woven tubular material flattened into double-ply fabric. The recovery of the shoulder straps can be between 91% to 98%. In some examples, the shoulder straps have rounded edges. In some examples, the woven tubular material forming the shoulder straps comprises elastomeric yarns. The woven tubular material forming the shoulder straps can include a weft yarn and a weave yarn, the weft yarn having different material properties than the weave yarn. In some examples, each shoulder strap has a width of from 10 millimeters to 26 millimeters. In some examples, the thickness of each shoulder strap is from 0.5 millimeters to 1.5 millimeters.

Methods of making the upper body garments disclosed herein include forming a breast supporting region, forming shoulder straps by weaving a tubular material and flattening the tubular material into a double-ply fabric, and forming a body strap. The methods further include attaching the first and second sides of the body strap to the breast supporting region. The methods further include attaching the front sides of the left and right shoulder straps to the breast supporting region and attaching the back sides of the left and right shoulder straps to the body strap.

In some examples of the methods of making the upper body garments, the step of forming the body strap further includes integrally knitting a first side section, a back section, and a second side section into a tubular material. The back section can include a first transition portion, a first intermediate portion, a middle portion, a second intermediate portion, and a second transition portion. The first and second transition portions can be symmetrical and can gradually narrow toward the first and second intermediate portions. The first and second intermediate portions can gradually narrow toward the middle portion.

In some examples of the methods of making the upper body garments, the first and second side sections are integrally knit into a ribbed fabric. In some examples of the methods of making the upper body garments, the step of forming the body strap further includes flattening the tubular material of the body strap into a double-ply fabric.

BRIEF DESCRIPTION OF THE DRAWINGS

The device is explained in even greater detail in the following drawings. The drawings are merely exemplary to illustrate the structure of garments and certain features that may be used singularly or in combination with other features. The drawings are not necessarily drawn to scale.

DETAILED DESCRIPTION

Figure 1:
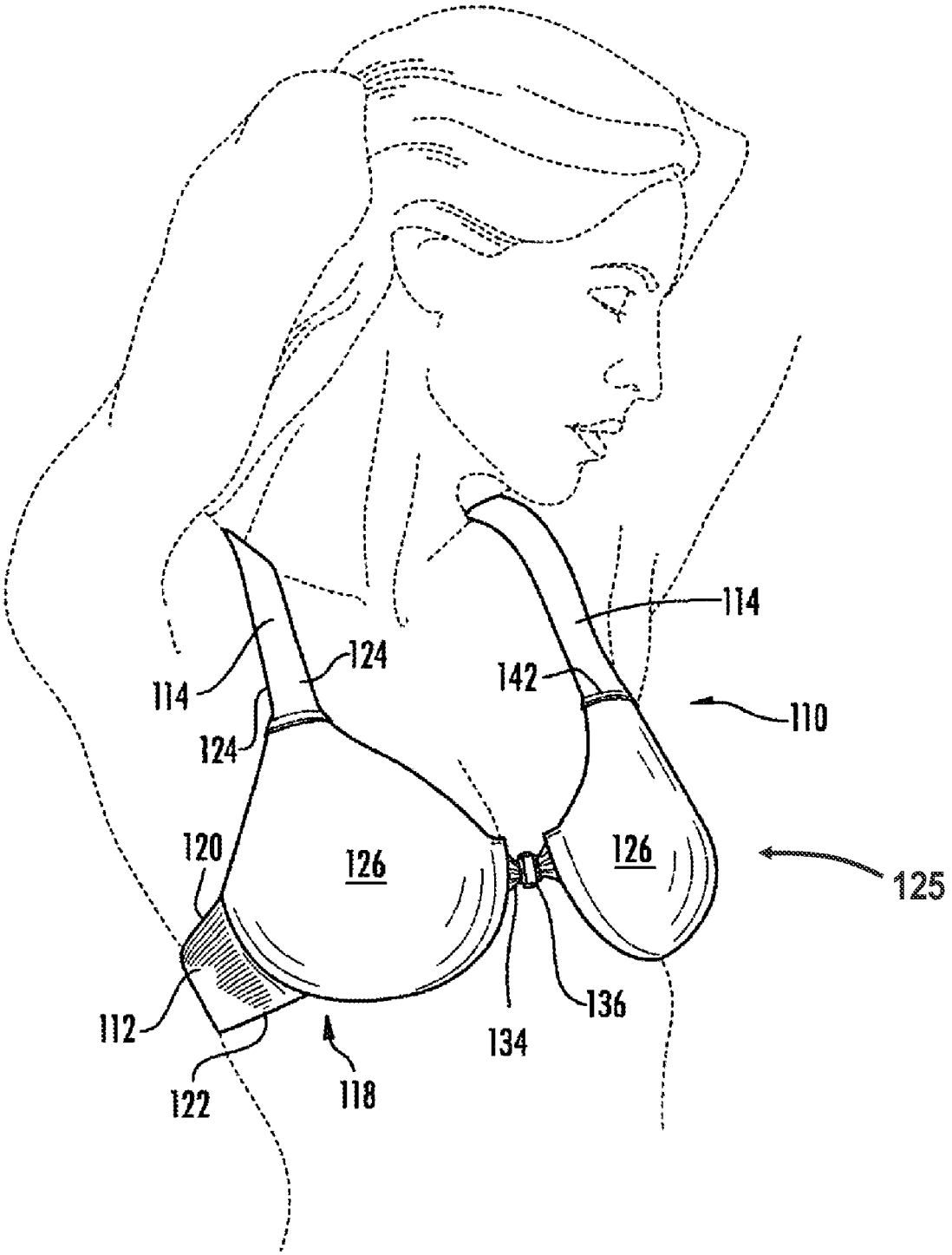
FIG. 1 is a front perspective view of an embodiment of the upper body garment on the body of a wearer.

This description below refers to certain aspects of the garment relative to other aspects of the garment or to the body of a wearer. As used herein, superior indicates a direction that is closer to the wearer's head. Inferior indicates a direction that is closer to the wearer's feet. Upward, upper, or uppermost indicates a superior direction, or toward a wearer's head. Downward, lower, or lowermost indicates an inferior direction, or toward a wearer's feet. The longitudinal direction refers to an axis extending between the upper and lower edges of the garment, or between the wearer's head and feet. Lateral indicates a positioning that is closer to the sides of the wearer. Medial indicates a positioning that is farther from the sides of the wearer. Anterior indicates a positioning closer to the front of a wearer. Posterior indicates a positioning closer to the back of a wearer. The terms right and left are in reference to the wearer's body. The comparative words "relatively" and "moderately" as used herein are to be understood to mean the relation of the characteristics of one section or area of the upper body garment in comparison with other sections and areas.

The following description of certain examples of the inventive concepts should not be used to limit the scope of the claims. Other examples, features, aspects, embodiments, and advantages will become apparent to those skilled in the art from the following description. As will be realized, the device and/or methods are capable of other different and obvious aspects, all without departing from the spirit of the inventive concepts. Accordingly, the drawings and descriptions should be regarded as illustrative in nature and not restrictive.

For purposes of this description, certain aspects, advantages, and novel features of the embodiments of this disclosure are described herein. The described methods, systems, and apparatus should not be construed as limiting in any way. Instead, the present disclosure is directed toward all novel and nonobvious features and aspects of the various disclosed embodiments, alone and in various combinations and sub-combinations with one another. The disclosed methods, systems, and apparatus are not limited to any specific aspect, feature, or combination thereof, nor do the disclosed methods, systems, and apparatus require that any one or more specific advantages be present or problems be solved.

Features, integers, characteristics, compounds, chemical moieties, or groups described in conjunction with a particular aspect, embodiment or example of the invention are to be understood to be applicable to any other aspect, embodiment or example described herein unless incompatible therewith. All of the features disclosed in this specification (including any accompanying claims, abstract, and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract, and drawings), or to any novel one, or any novel combination, of the steps of any method or process so disclosed.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. The terms "about" and "approximately" are defined as being "close to" as understood by one of ordinary skill in the art. In one non-limiting embodiment the terms are defined to be within 10%. In another non-limiting embodiment, the terms are defined to be within 5%. In still another non-limiting embodiment, the terms are defined to be within 1%.

"Optional" or "optionally" means that the subsequently described event or circumstance may or may not occur, and that the description includes instances where said event or circumstance occurs and instances where it does not.

As illustrated in the accompanying drawings, the upper body garment 110 of the embodiment of FIG. 1 has a circular knit, tubular body strap 112, a breast supporting region 125 comprising a pair of cups 126, and a pair of woven tubular shoulder straps 114. The body straps 112 and shoulder straps 114 are formed of (or include) elastomeric yarns, such as a nylon wrapped spandex (also known as elastane, or Lycra®) core yarn. The body strap 112 is formed from a length of circular knit, tubular material (FIG. 6), flattened into a double-ply fabric. The body strap 112 is coupled on either side to breast supporting region 125 at cups 126 to form a torso-encircling main body portion 118. The body strap is relatively narrow tube, and the longitudinal axis of the tube encircles the torso of the wearer.

Being a circular knit, tubular, flattened fabric, the body strap 112 has rounded upper and lower edges 120, 122. As such, no edging or other strips are necessary to cover edges that are typically formed in conventional bras when cutting material to the shape of the bra from woven material, or from single-ply circular knit material, or from double-ply circular knit material where the axis of the tube is vertical with respect to the wearer. The resulting smooth edges avoid the uncomfortable and irritating edges of bras and that create unsightly bulges.

To provide form fitting characteristics and desired stretchability to the main body portion 112, the upper body garment can include relatively tightly knit, relatively less-stretchable side sections 130 coupled to the breast supporting region 125. The side sections 130 extend around to a back section 132. The back section 132 is more loosely knit than side sections 130 (i.e., the yarns are not as densely packed) and is thus the back section 132 is more stretchable and resilient than the tightly knit side sections 130. The back section 132 extends between the left and right side sections 130, across the back of the wearer. In some embodiments, the side sections 130 are knit ribbed fabric that extends from the breast supporting region 125 to provide desired relative form fitting support in the upper body garment 110. The relatively tightly knit, relatively non-stretchable, pronounced ribbed fabric areas taper rearwardly and downwardly to form complementary tapered areas of relatively lesser tightly knit fabric. These areas provide desired form fitting support in the upper body garment.

Figure 3:
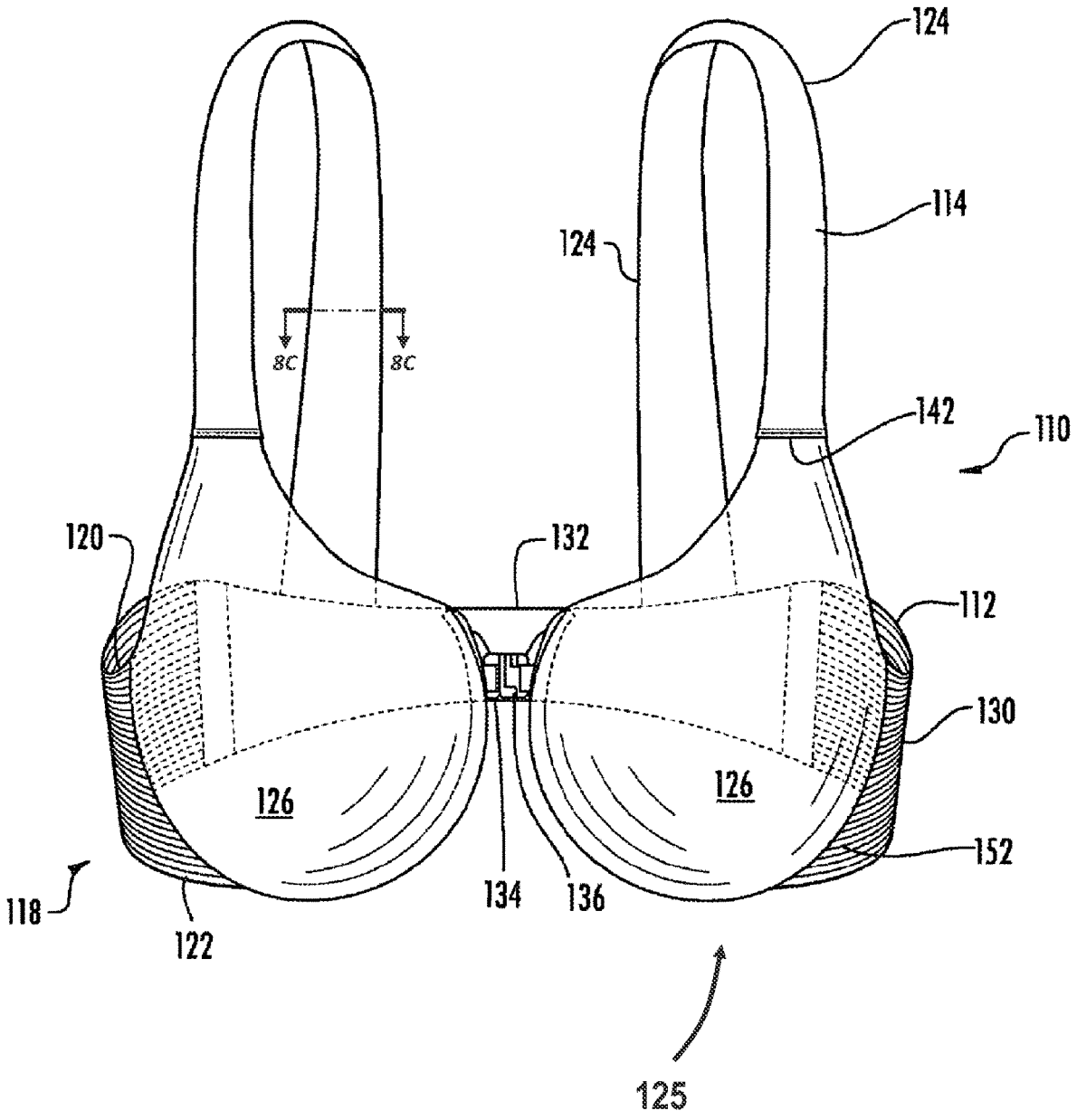
FIG. 3 is a front elevation of the upper body garment of FIG. 1.
Figure 4:
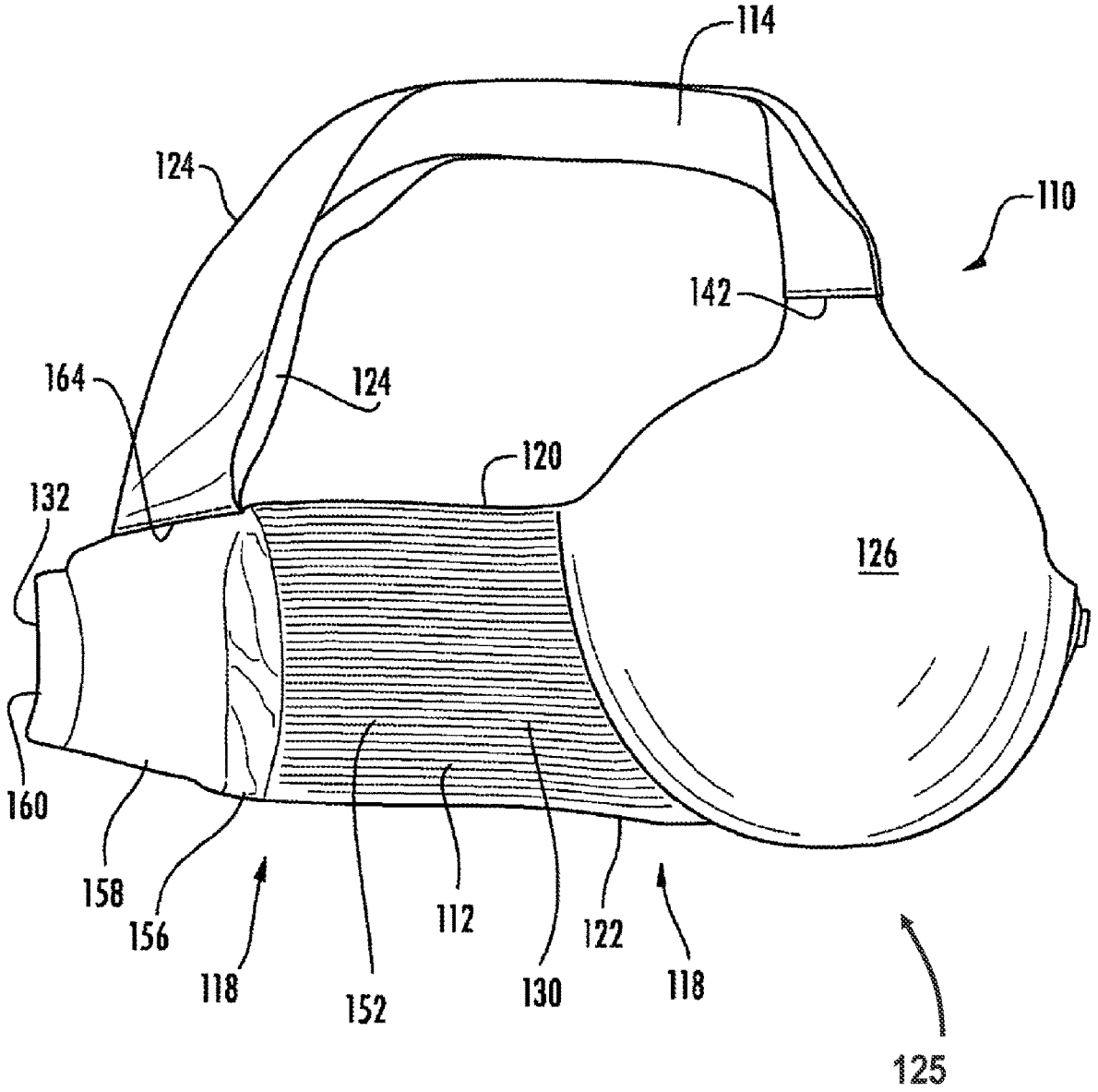
FIG. 4 is a side elevation of the upper body garment of FIG. 3 in relaxed condition.
Figure 5:
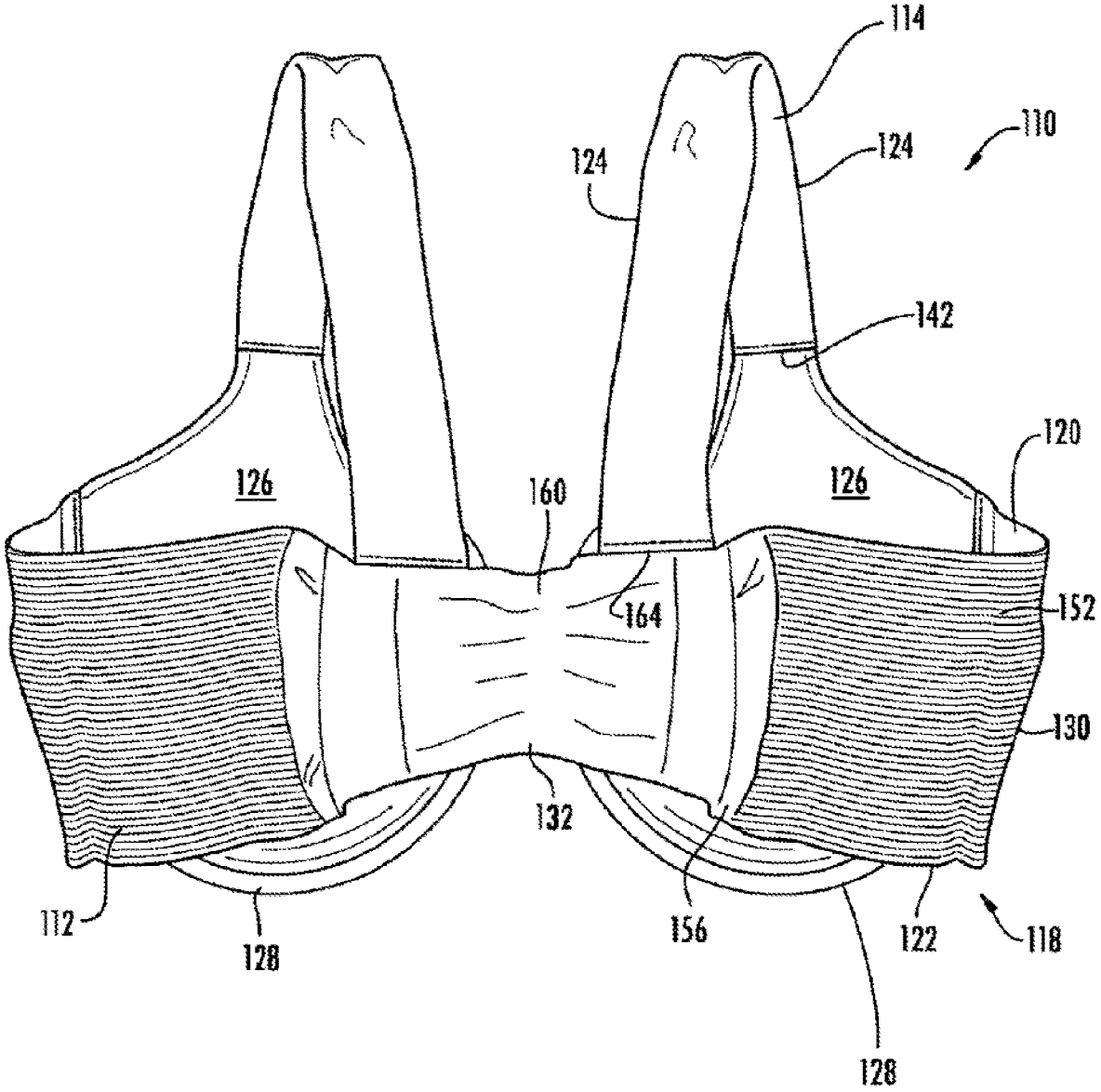
FIG. 5 is a rear elevation of the upper body garment of FIG. 3 in relaxed condition.
Figure 6:
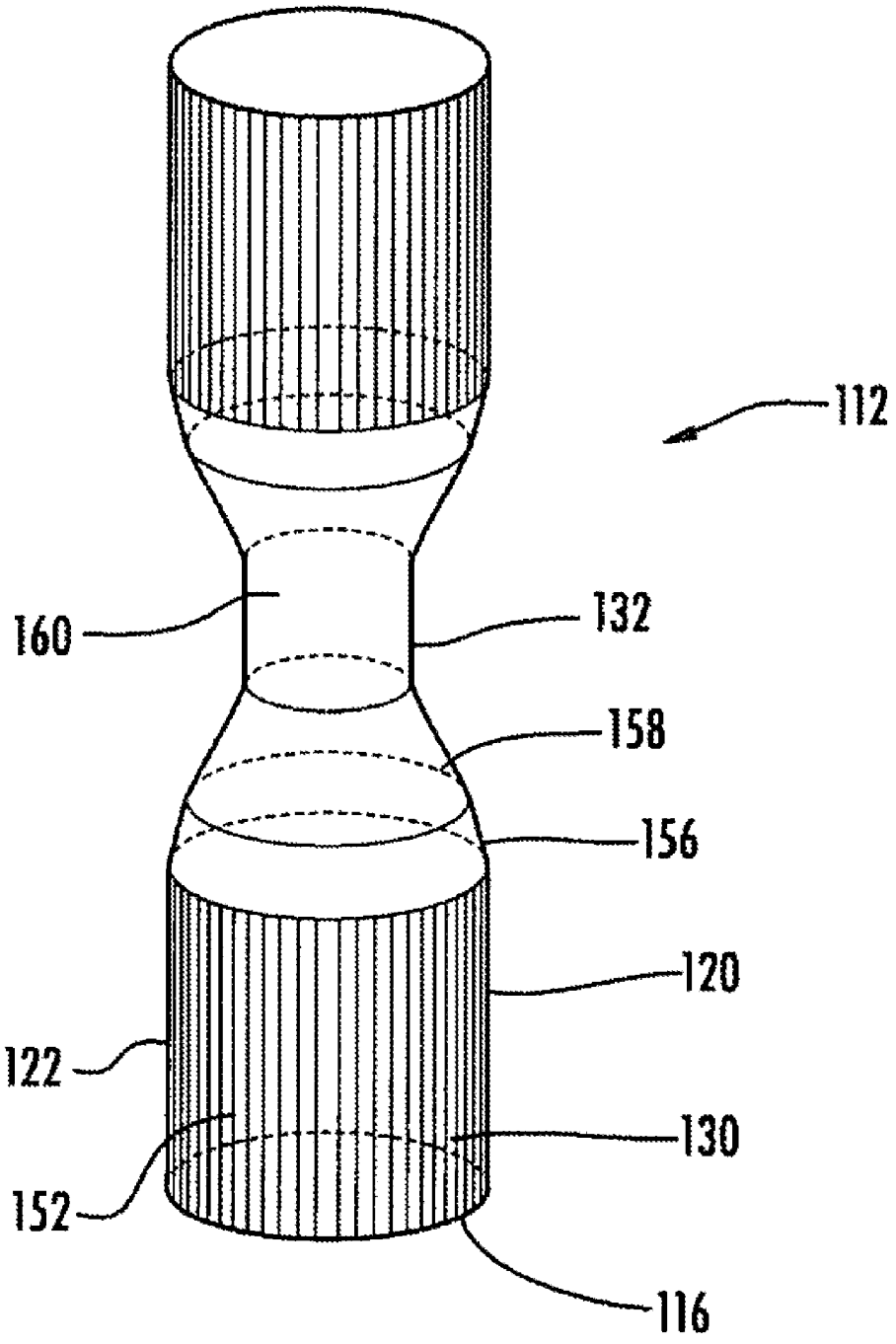
FIG. 6 is an illustration of a length of fabric in tubular form as knit on a circular knitting machine prior to being flattened to form the main body portion of the upper body garment of FIG. 1.

FIGS. 3, 4, and 5 illustrate an embodiment of upper body garment 110 in its relaxed, unworn condition. FIG. 6 shows a length 118 of circular knit material in the form of the tube in which it is knit, prior to being flattened to form the body strap 112. The end 116 at the bottom of the figure is the first portion to be knit. Knitting then progresses through the side section 130, which is relatively tightly knit and relatively non-stretchable, beginning with a ribbed fabric area 152 to form the complete side section 130. Following the knitting of the side section 130, knitting continues with the knitting of the back section 132, which begins with a short transition portion 156 that narrows slightly inwardly to an intermediate portion 158 to a slightly narrowed middle portion 160. Knitting then continues in the reverse order and is completed when the upper end 112 of the length of material 118 is knit and the length of material 118 is removed from the knitting machine. The length 118 is then flattened into a double-ply fabric and the ends 116 are coupled to the breast supporting region 125.

The fabric for the body strap can be rapidly and inexpensively knit using hosiery knitting machines or other suitable machines that knit seamless fabric. The body strap fabric is made with (or at least includes) elastomeric yarns, with the knitting pattern being variable to produce desirable stretchable and relatively non-stretchable sections in the fabric to suit desired characteristics in the finished upper body garment. In an example of the present invention, the body strap 112 is knit on a 400 needle, 4 feed, 4 inch cylinder hosiery knitting machine, such as a Matec HF 4.7 VM (Variable Movement, i.e., the stitch cam is controlled to go in and out and up and down) using a stretch yarn having a spandex core covered by a textured stretch nylon filament yarn wrapped around the core. Other machines that produce circular knit fabric and other types of yarn may be used as desired.

Figure 2:
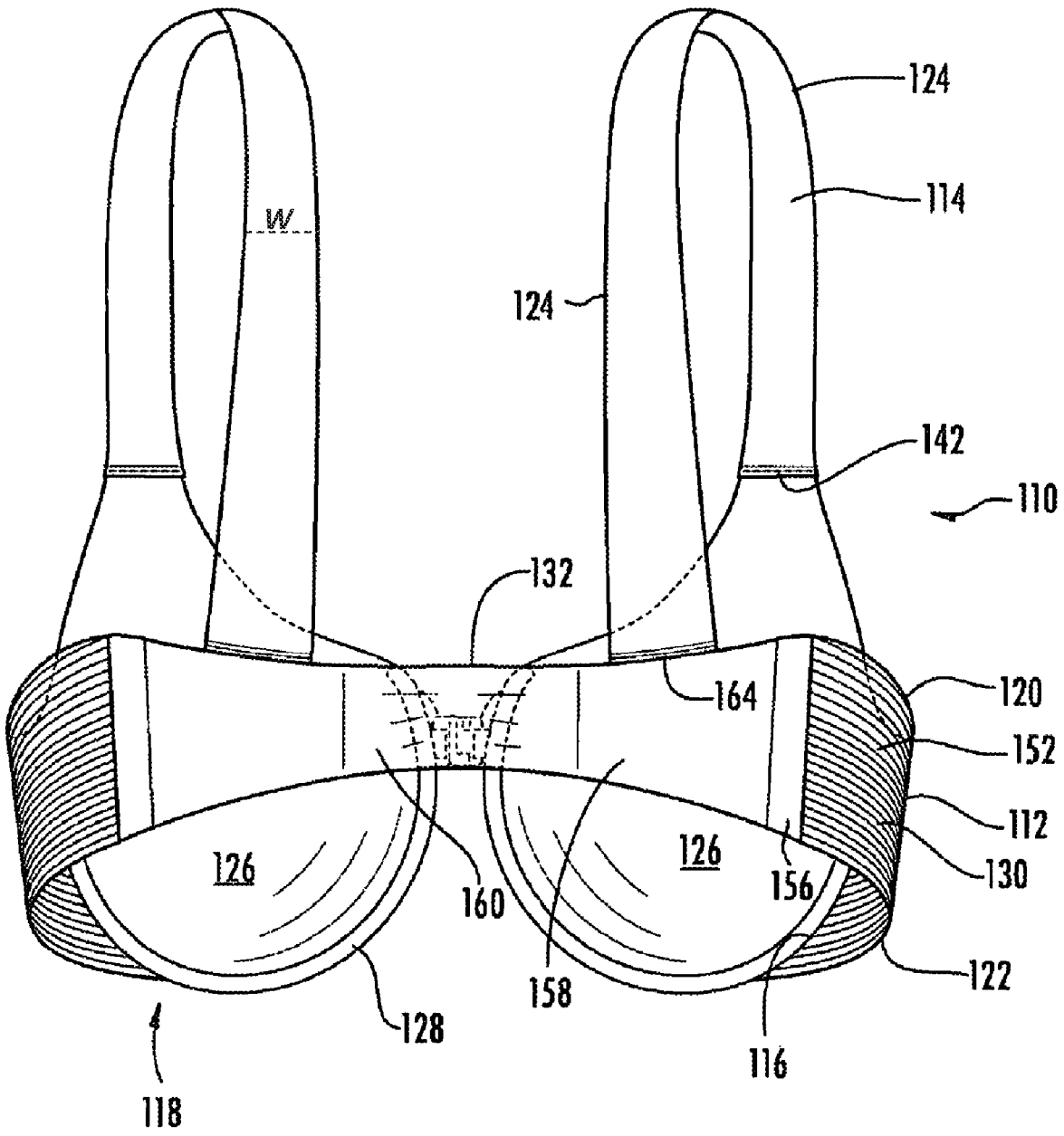
FIG. 2 is a rear perspective view of the upper body garment of FIG. 1 as it appears on a wearer.

Breast supporting regions 125 can be formed of the same material as body strap 112 (as described in U.S. Pat. No. 7,654,115) or it can be formed of a different material from the material of the body strap 112 (as described in U.S. Pat. No. 7,549,302). For example, breast supporting region 125 can include cups 126 that are formed of foam plastic material, with or without the underwires 128 shown in FIG. 2. However, the invention is not limited to a particular type of breast supporting region 125, or even a particular type of upper body garment. The woven tubular shoulder straps 114, described in more detail below, can in fact be used with any bra or upper body garment requiring shoulder straps (including, for example, camisoles and tank tops).

In some embodiments, cups 126 can be removably coupled to each other by a fastener. For example, in the embodiment shown in FIG. 3, there is a relatively short front section 134, in the center of which there is a hook connector 136 for attaching the upper body garment 110 to a wearer. As shown in FIG. 4, the shoulder straps 114 have front sides 142 that are coupled to the top of the breast supporting region 125 and extend upwardly from the breast supporting region 125. The shoulder straps 114 extend uniformly from their front sides 142 to their back sides 164, which are coupled to the main body portion 112. The shoulder straps 114 are typically coupled by sewing, but other methods of securement can be envisioned (such as bonding, for example).

The shoulder straps 114 are formed from a pair of lengths of woven tubular material. Each shoulder strap is formed of a length of woven tubular material, flattened into a double-ply fabric. For each shoulder strap, the front and back sides are secured to the breast supporting region and the body strap, respectively. This results in an upper body garment that can be rapidly and inexpensively produced with the resulting garment being free of any uncomfortable and unsightly edging strips either on the main body portion or on the shoulder straps. The width of the woven tubular shoulder straps is easily varied, and can be tailored to the size of the intended wearer. The woven tubular shoulder straps disclosed herein can be utilized in conjunction with the brassieres disclosed in U.S. Pat. Nos. 7,549,302 and 7,654,115, which are each incorporated by reference herein in their entireties. For that matter, the woven tubular shoulder straps disclosed herein can be utilized with any brassiere, camisole, tank top, or other upper body garment requiring shoulder straps.

Figure 7:
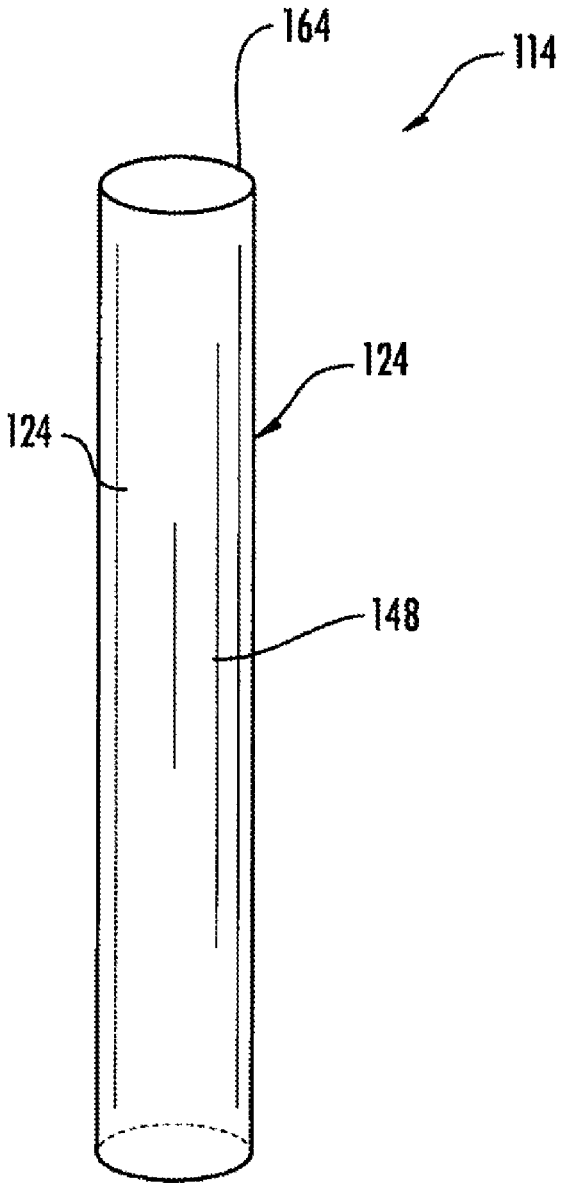
FIG. 7 is an illustration of a length of woven tubular fabric in tubular form prior to being flattened to form the shoulder strap of the upper body garment of FIG. 1.

FIG. 7 shows a length 148 of a woven tubular material in the form of the tube in which it is woven, prior to being flattened to form a shoulder strap 114. Once lengths 148 are flattened into double-ply fabrics to form shoulder straps 114, they are oriented and coupled to the upper body garment such that the axes of the lengths 148 of material extend vertically with respect to the wearer. As a result, side edges 124 are formed by the folded edges of the lengths of material, and require no edging or other strip material on the edges. This avoids the discomfort, irritation, unsightliness and bulging of conventional shoulder straps, an advantage that is enhanced by the shoulder straps 114 being of sufficient width to avoid digging into the shoulders of the wearer. Notably, however, woven tubular shoulder straps 114 may also be formed as narrow (as measured in a medial to lateral direction) or as wide as desirable for the intended purpose and user. This is a distinct advantage over the circular knit, tubular shoulder straps described in U.S. Pat. No. 7,549,302, where the minimum lateral width was dictated by the circular knitting process and machine. For example, the shoulder straps 114 disclosed herein can be anywhere from 10 to 26 millimeters wide, as measured in the medial to lateral direction (see width, W, in FIG. 2).

One length 148 of the woven tubular material that forms a shoulder strap 114 is illustrated in FIG. 7. The back end 164 of the length 148 is seen at the top of FIG. 7. This is the side that is coupled to body strap 112 of the main body portion 118. Length 148 of the woven tubular material continues to a front end 142, which is coupled to a breast supporting region 125 of the main body portion 112. After the tubular length 118 of the main body portion and the tubular lengths 148 of the shoulder straps 114 are formed, they are flattened. The shoulder straps 114 are then coupled to the body strap 112 and to the breast supporting region 125, as shown in FIG. 4. Being a woven tubular, flattened fabric, the shoulder straps 114 have rounded lateral edges 124, as shown in FIG. 7B. The resulting smooth edges avoid the uncomfortable and irritating edges of bras and that create unsightly bulges.

Figure 8A:
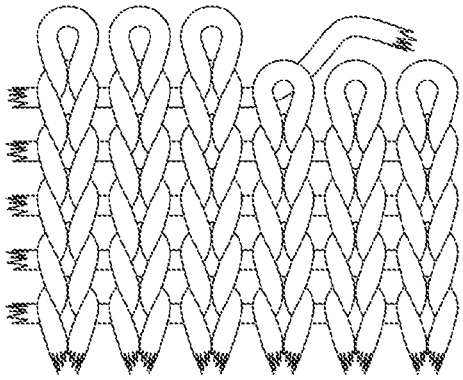
FIG. 8A is an illustration of a knit fabric.
Figure 8B:
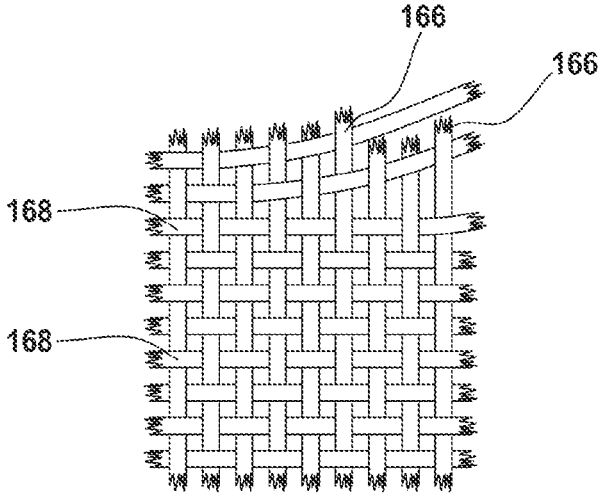
FIG. 8B is an illustration of a woven fabric.

The structure of a woven material, such as is used in shoulder straps 114, includes warp yarns 166 and weft yarns 168. The interlocking of the warp 166 and weft 168 gives a more stable fabric than a knit structure using the same type of yarn. See FIG. 8A (woven) versus FIG. 8B (knit). The structure of woven material also allows for greater recovery and stability than knit material using the same yarn; a woven structure gives tighter tension and has many more yarn ends than a knit, which is constructed using a continuous interlooping of fewer yarns. For example, the recovery of woven tubular shoulder straps 114 is from about 91% to about 98%, as opposed to about 75.6% for knit shoulder straps of the same dimensions and formed of the same type of yarn. The recovery is measured using ASTM D4964, where the elastic is sewn into a 4" loop (flat, 8" total) then stretched to an indicated load, in this case 50N, then relaxed. After relaxing for 1 minute the loop length is measured to determine if the loop recovered to its original size or lengthened under the load. The amount the loop increases determines its recovery percentage.

Advantageously, wovens can incorporate different types of yarns into the warp 166 versus the weft 168. This allows for a tailoring of mechanical properties, such as strength and recovery, to suit the support needs for the intended wearer. Knits, on the other hand, allow for only one type of yarn to be used, giving the designer less ability to tailor the mechanical properties of the shoulder straps to the intended wearer. As an example of the versatility of woven tubular straps, warp yarns 166 might use 280 denier spandex and weft yarns use 280 denier spandex yarns 168 to provide the shoulder straps 114 with greater modulus thereby providing more support to a larger bust size (D+). Yarns with a higher spandex content are more powerful for example. Yarns utilizing lower denier spandex yarns are less powerful and have an easier stretch. As another example, for smaller bust sizes (A, B, and C), the spandex content of the warp yarn 166 might be from 70-140 denier, while the spandex content of the weft yarn 168 might be from 40-140 denier. The nylon deniers can be adjusted as well. For larger sizes you may use a 40D nylon to cover spandex but only need to use a 20D nylon to cover the spandex for the smaller sizes.

Furthermore, the amount of support provided can be varied by changing the width of straps 114. With woven tubular straps, the width can be adjusted by changing both the tension and the number of yarn ends used in the warp of the fabric. For instance, a strap that is 26 mm wide might use over 500 yarn ends in the warp. By contrast, a strap that is 14 mm wide would use less than 300 ends in the warp.

Figure 8C:
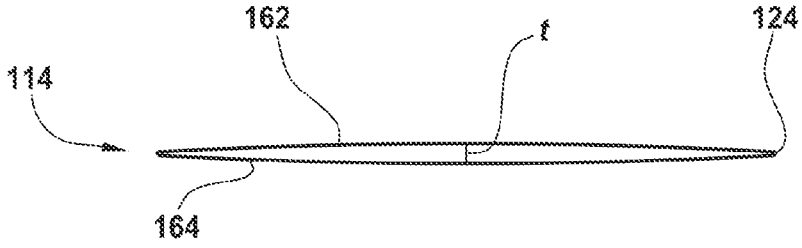
FIG. 8C is a cross-sectional view of a flattened shoulder strap as taken from the section lines shown in FIG. 2.

Advantageously, the weaving process also creates a thinner fabric than the knitting process, even when using the same kind of yarn, such that the woven tubular shoulder straps 114 are thinner than the circular knit, tubular shoulder straps described in U.S. Pat. No. 7,549,302. This is advantageous because a thinner fabric is less visible under the clothing. For example, the thickness, t, of the woven tubular shoulder straps 114 disclosed herein is from about 0.5 millimeters to about 1.5 millimeters as measured from the upper surface 162 of the shoulder strap 114 to the lower surface 164 of the shoulder strap 114 as shown in FIG. 8C (including about 0.5 millimeters, about 0.6 millimeters, about 0.7 millimeters, about 0.8 millimeters, about 0.9 millimeters, about 1 millimeter, about 1.1 millimeters, about 1.2 millimeters, about 1.3 millimeters, about 1.4 millimeters, and about 1.5 millimeters). By contrast, the thickness of a circular knit, tubular shoulder strap tends to be from 2 millimeters to 3 millimeters. Woven fabrics are thinner than knit fabrics using the same yarn because the yarns of a woven fabric because the yarns are denser and more compacted than with a knit structure (for example, compare the knit fabric structures in FIG. 8A to the woven fabric structures in FIG. 8B).

Methods of making the upper body garments disclosed herein include forming shoulder straps by weaving a tubular material and flattening the tubular material into a double-ply fabric. A machine used to form the tubular material first weaves two elongated single-ply lengths of fabric, then connects the two lengths to form a tube. The yarns used to form the lengths of woven tubular material forming the shoulder straps 114 are elastomeric. For example, the yarn can be nylon wrapped spandex core yarn. Front sides of each of a left and right shoulder strap are coupled to the breast supporting region of the upper body garment. Back sides of each of the left and right shoulder straps are coupled to the body strap of the upper body garment. The body strap may be a length of a circular knit, tubular material, formed as disclosed above. However, the invention is not limited to any particular type of body strap. In fact, the woven tubular shoulder straps 114 disclosed herein could be attached to any type of bra, camisole, tank top, or other upper body garment.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications, variations, and/or combinations of the features disclosed herein will be apparent to those of ordinary skill in the art without departing from the scope and spirit of the invention. The implementation was chosen and described in order to best explain the principles of the invention and the practical application, and to enable others of ordinary skill in the art to understand the invention for various implementations with various modifications as are suited to the particular use contemplated.

The invention claimed is:

1. An upper body garment comprising:

a torso-encircling main body portion comprising a breast supporting region coupled to a body strap, the body strap including side sections coupled to the breast supporting region and a back section extending from the side sections; and shoulder straps coupled to the main body portion;

wherein the body strap is formed of a circular knit, tubular material flattened into double-ply fabric;

wherein each shoulder strap is formed of a woven tubular material flattened into double-ply fabric, the woven tubular material comprising a warp yarn extending along a length of the shoulder strap and a weft yarn extending across the length of the shoulder strap; and wherein the recovery of the shoulder straps is between 91% to 98%.

2. The upper body garment of claim 1, wherein the fabric of the side sections of the body strap has a lower elasticity than the fabric of the back section of the body strap.

3. The upper body garment of claim 1 wherein the double-ply fabric of the side sections of the body strap is more tightly knit than the double-ply fabric of the back section of the body strap.

4. The upper body garment of claim 1 wherein the shoulder straps have rounded edges.

5. The upper body garment of claim 1, wherein the woven tubular material forming the shoulder straps comprises elastomeric yarns.

6. The upper body garment of claim 1, wherein the warp yarn has different material properties than the weft yarn.

7. The upper body garment of claim 1, wherein each shoulder strap has a width of from 10 millimeters to 26 millimeters.

8. The upper body garment of claim 1, wherein the thickness of each shoulder strap is from 0.5 millimeters to 1.5 millimeters.

9. An upper body garment comprising:

a torso-encircling main body portion comprising a breast supporting region coupled to a body strap; and shoulder straps coupled to the main body portion;

wherein the body strap is formed of a circular knit, tubular material flattened into double-ply fabric; and wherein each shoulder strap is formed of a woven tubular material flattened into double-ply fabric, the woven tubular material comprising a warp yarn extending along a length of the shoulder strap and a weft yarn extending across the length of the shoulder strap; and wherein the warp yarn has different material properties than the weft yarn.

10. The upper body garment of claim 9, wherein the body strap includes side sections coupled to the breast supporting region and a back section extending from the side sections, wherein the double-ply fabric of the side sections of the body strap is more tightly knit and has a lower elasticity than the double-ply fabric of the back section.

11. The upper body garment of claim 9, wherein the shoulder straps have rounded edges.

12. The upper body garment of claim 9, wherein the recovery of the shoulder straps is between 91% to 98%.

13. The upper body garment of claim 9, wherein the woven tubular material forming the shoulder straps comprises elastomeric yarn.

14. The upper body garment of claim 9, wherein each shoulder strap has a width of from 10 millimeters to 26 millimeters.

15. The upper body garment of claim 9, wherein the thickness of each shoulder strap is from 0.5 millimeters to 1.5 millimeters.

16. The upper body garment of claim 9, wherein the breast supporting region comprises a material different from the material of the body strap and the material of the shoulder straps.

17. A method of making an upper body garment, the method comprising:

forming a breast supporting region;

forming left and right shoulder straps by weaving a tubular material for each shoulder strap and flattening the tubular material into a double-ply fabric, such that a warp yarn of the tubular material extends along a length of the shoulder strap and a weft yarn of the tubular material extends across the length of the shoulder strap; wherein the recovery of the shoulder straps is between 91% and 98%;

forming a body strap by knitting a tubular material via circular knitting and flattening the knit tubular material into a double-ply fabric;

attaching a first side of the body strap to the breast supporting region and a second side of the body strap to the breast supporting region;

attaching a front side of the left shoulder strap to the breast supporting region and a back side of the left shoulder strap to the body strap; and attaching a front side of the right shoulder strap to the breast supporting region and a back side of the right shoulder strap to the body strap.

18. The method of claim 17, wherein knitting the knit tubular material of the body strap further comprises integrally knitting a first side section, a back section, and a second side section;

wherein the back section comprises a first transition portion, a first intermediate portion, a middle portion, a second intermediate portion, and a second transition portion; and wherein the first and second transition portions are symmetrical and gradually narrow toward the first and second intermediate portions, and the first and second intermediate portions gradually narrow toward the middle portion.

19. The method of claim 18, wherein integrally knitting the first and second side sections further comprises knitting the first and second side sections into ribbed fabric.

* * * * *